United States Patent [19]

Astolfi

[11] Patent Number: 4,989,353

[45] Date of Patent: Feb. 5, 1991

[54] TABLE-TOP PICTURE FRAME WITH TWO DETACHABLE SECTIONS

[75] Inventor: Pietro Astolfi, Bologna, Italy

[73] Assignee: Pico-Glass, S.p.A., Cadriano, Italy

[21] Appl. No.: 327,330

[22] Filed: Mar. 22, 1989

[30] Foreign Application Priority Data

Oct. 4, 1988 [IT] Italy ..... 22177 A/88

[51] Int. Cl.[5] ..... A47G 1/06

[52] U.S. Cl. ..... 40/152.1; 40/152

[58] Field of Search ..... 40/152, 152.1, 159.2, 40/158.1

[56] References Cited

U.S. PATENT DOCUMENTS

| | | | |
|---|---|---|---|
| 2,639,530 | 5/1953 | Merrill | 40/152 |
| 4,432,152 | 2/1984 | Daenen | 40/152.1 |
| 4,608,770 | 9/1986 | Gray | 40/152 |
| 4,656,764 | 4/1987 | Fengler | 40/152.1 X |
| 4,736,539 | 4/1988 | Dickinson | 40/152.1 X |

*Primary Examiner*—James R. Brittain

*Attorney, Agent, or Firm*—Darby & Darby

[57] ABSTRACT

A table-top picture frame is disclosed which is formed with detachable front and rear sections joined by a coupling system which permits ready separation. The frame has a supporting leg which is pressed into a groove on one of the two sections of the frame, thus becoming the table-top support for the frame. This leg, if removed from the groove, can be inserted into another groove between the two sections of the frame at their juncture, in order to pry them apart.

4 Claims, 2 Drawing Sheets

TABLE-TOP PICTURE FRAME WITH TWO DETACHABLE SECTIONS

FIELD OF THE INVENTION

The invention relates generally to picture frames and, more particularly, concerns a table-top frame made in two sections joined together by means of a coupling system which permits the two sections to be separated when necessary.

BACKGROUND OF THE INVENTION

There are many types of table-top picture frames known which differ from one another both according to the solutions adopted for retaining the picture and protective transparent protective panel inside the frame and, for the particular model chosen by the manufacturer from an esthetic point of view so as to orientate the consumer towards one's own product.

There is, however, a characteristic which is substantially common to all table-top frames and which consists in the fact that their structure is essentially made up of a framework with at least one opening through which the picture is visible, in the opening a recess has been created on which the said picture and its protective panel rest. The back of the frame has a backboard fixed to the framework by means already known, for example removable metal hooks. To the backboard is attached a support which keeps the frame in an upright position on a shelf or table-top.

Conventional table-top frames therefore are made in such a way that it is difficult to replace the picture particularly as regards the removal and re-application of the retaining hooks.

Furthermore, it is to be noted that the presence of the support sometimes hinders the operation of removing the hooks, thereby making the above-mentioned operation even more difficult.

A table-top frame which overcomes all the problems mentioned above has now been developed and constitutes the object of this invention.

One of the principle objects of this invention is to provide a frame structure which does not require the use of traditional metal hooks, thus eliminating all the complex operations necessary for replacing the picture.

Another object is to provide a frame in which the support element or foot also acts as a means for opening the frame for the substitution of the image.

Another important feature of the frame according to the present invention is that of being able to put two pictures in it and display one or the other as desired.

In accordance with a preferred embodiment, a table-top picture frame is formed with front and rear sections joined by a coupling system which permits ready separation. The frame has a supporting leg which is pressed into a groove on either of the two sections of the frame, thus becoming the table-top support for the frame. This leg, if removed from the groove, can be inserted into another groove formed between the two sections of the frame at their juncture, in order to pry them apart.

The characteristics as well as the advantages of a table-top frame according to the present invention will become more evident from the following detailed description of a preferred embodiment, which is intended to be illustrative and not limiting. Reference will be made to the accompanying drawings in which.

Figure 3:
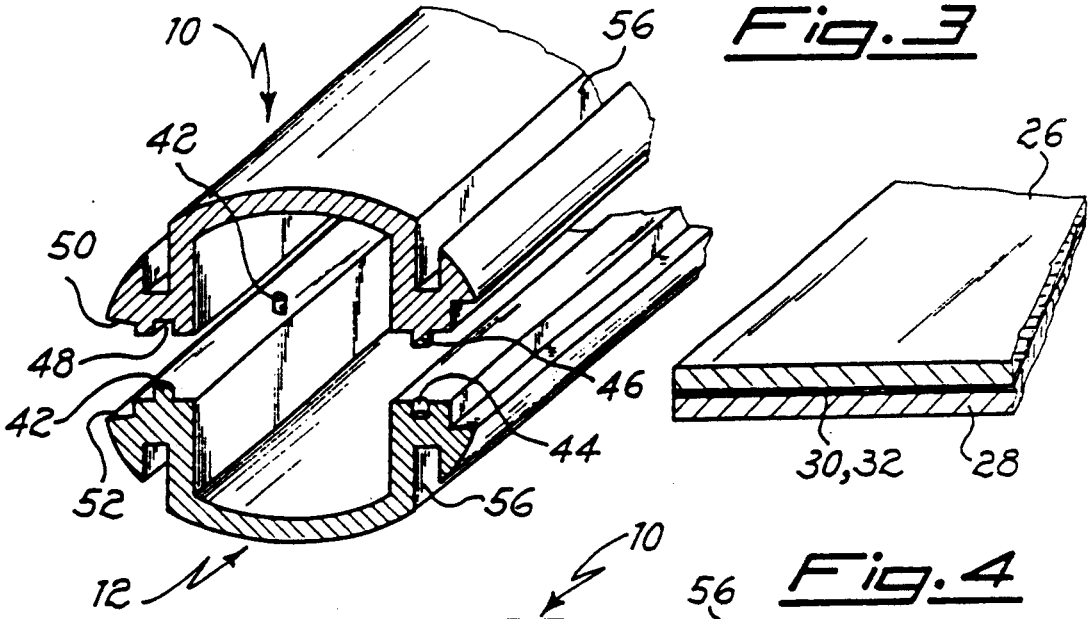
Figure 4:
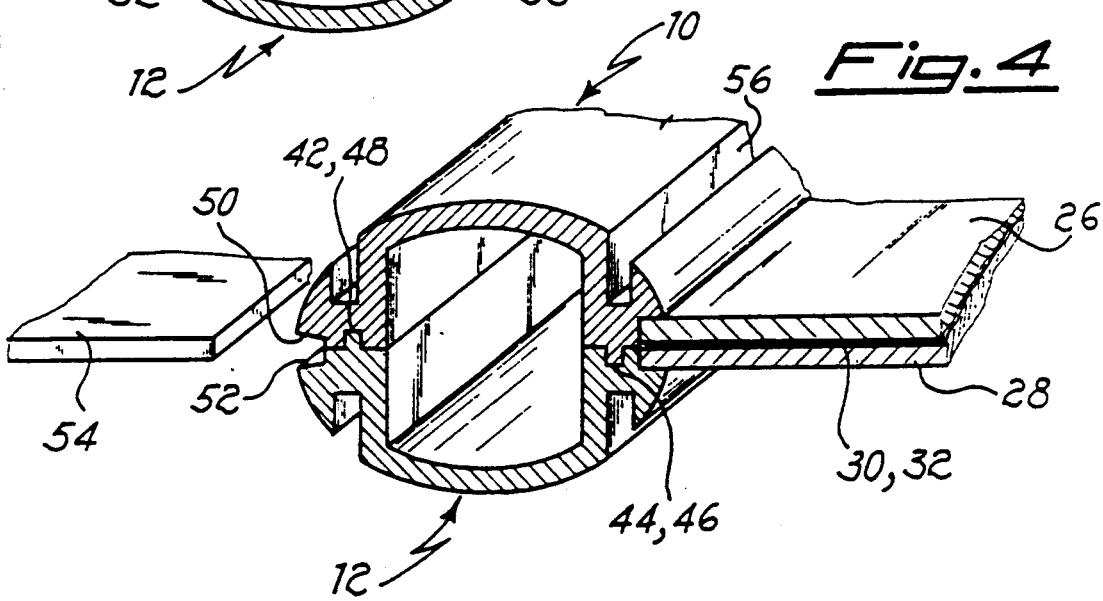

FIG. 3 a transversal section of a portion of the framework of the frame when open;

FIG. 4 the same section as FIG. 3 when the frame is closed, and

Figure 5:
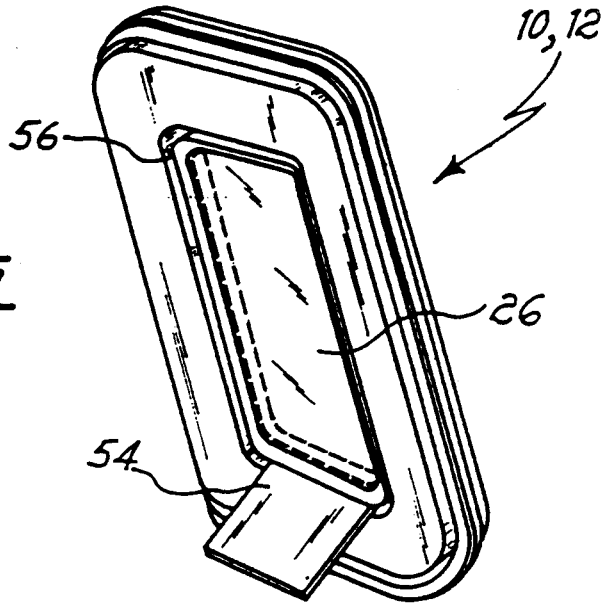

FIG. 5 is a perspective view of the rear of the frame when in use.

DETAILED DESCRIPTION OF THE PREFERRED EMBODIMENT

Figure 1:
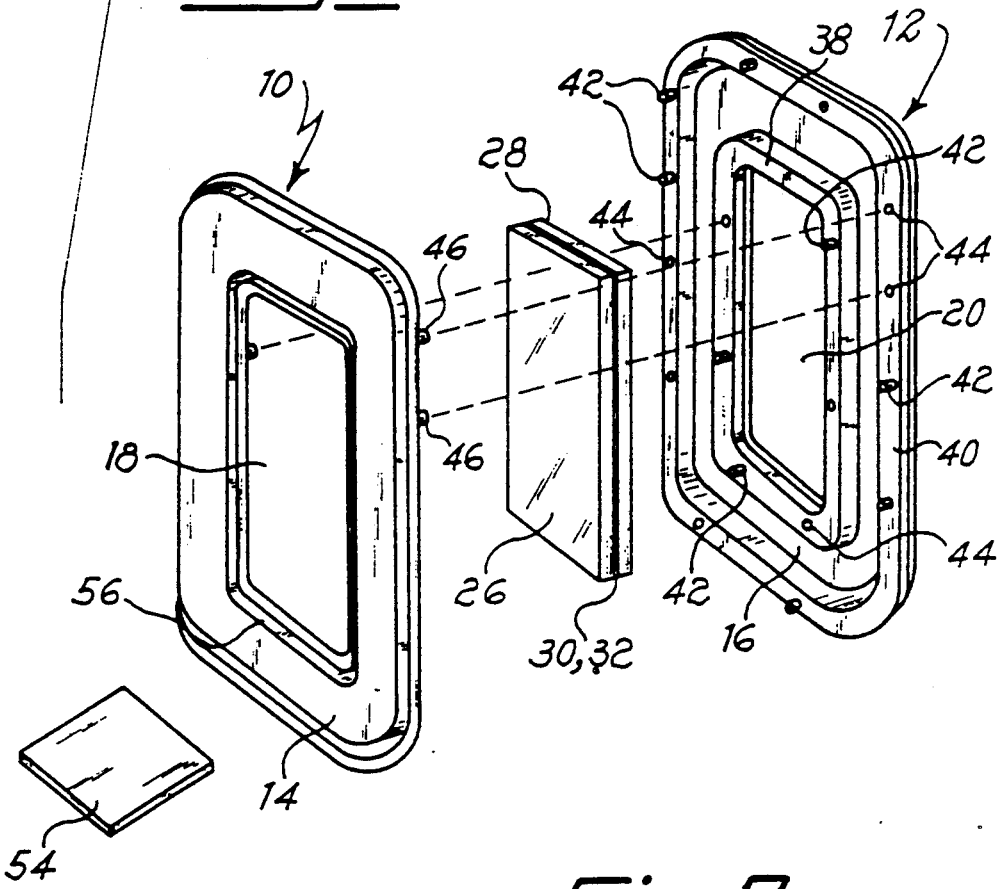
FIG. 1 is an exploded perspective view of a frame according to the present invention.
Figure 2:
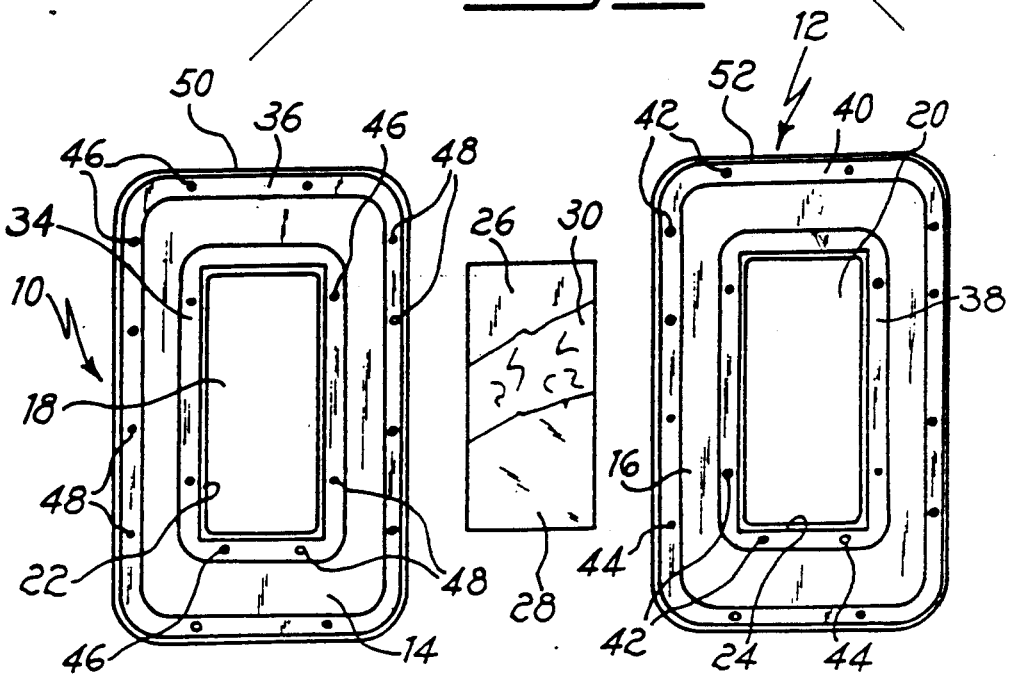
FIG. 2 is a view showing the frame when open, with the two halves placed side-by-side to illustrate interior details of the frame.

Referring first to FIGS. 1 and 2, the frame broadly comprises two parts 10, 12 which can be joined together by means of a slot-in coupling system which holds them together.

Each part 10, 12 is made up of a framework, substantially rectangular framework respectively, 14, 16 each having a central opening 18, 20 respectively.

On the periphery of each of the openings 18, 20 a recess 22, 24 is formed and the two recesses cooperate to define a housing for two pieces of glass 26, 28, between which are placed two pictures 30, 32.

Each of the parts 10, 12 making up the present frame has on the inside, an inner peripheral wall 34, 38 and an outer peripheral wall 36, 40. On the wall 40, which is the external one running around the outside edge of part 12, there are a large number of protrusions 42 and a large number of cavities 44. Similarly on the wall 36 of part 10, which is also on the outside, there are a large number of protrusions 46 and cavities 48. The inner walls 34 and 38 also have a large number of protrusions and cavities similar to those one the walls 36 and 40 which, therefore, are indicated with the same reference character used above.

The protrusions and cavities described above form a slot-in coupling system of part 10 to part 12 to make up the frame. In fact, the insertion of the protrusions into the corresponding cavities, indicated by the dashed lines in FIG. 1, solidly couples together the two parts, retaining the two glass panes 26, 28 and the two pictures 30, 32 on the inside in the housing mentioned above.

In conformity with another notable characteristic of the frame according to present invention, along the entire perimeter of parts 10, 12, there is provided a recess 50, 52, the function of which is important to the object of the present invention, as indicated hereunder.

With particular reference to FIGS. 3 and 4 it can first of all be seen that, the recesses 50 and 52 are preferably formed at a slight incline, that is, their sides diverge at a predetermined angle.

From FIG. 4 one can see that, when parts 20, 12 are assembled together the recesses 50, 52 form a groove along the whole length of the edges of the frame.

The frame according to the present invention has a plate 54 which, when the frame must be opened, in other words parts 10, 12 must be separated, is introduced by means of one of its edges into the groove created between the recesses 50, 52. By rotating the plate 54 the frame is easily and immediately opened.

In conformity with a further characteristic of the frame according to the invention the plate 54, as well as being a means of opening the frame, also acts as a supporting leg as illustrated in FIG. 5. For this purpose the frame according to the invention has, on the exterior surface of each of parts 10, 12 and in correspondence with glass panes 26, 28, a groove 56 which is cut in such a way that the edge of plate 54 can be pressed into the groove 56. Once inserted, the plate 54 acts as a supporting leg for the frame, as can be seen in FIG. 5.

The advantages of the frame according to the present invention are evident and the principle ones can be listed as follows:

1. An extremely simple construction;
2. Ease of assembly and disassembly;
3. The possibility of displaying either of the two pictures mounted in the frame.

Finally, it is clear that variations and/or modifications can be made to the table-top frame according to the present invention, without departing from the scope and spirit of the invention as defined by the accompanying claims.

I claim:

1. A table-top picture frame comprising:

front and rear frame portions, each having a picture-viewing opening and including means for retaining said picture in said opening;

complementary means concealed within said front and rear frame portions for retaining said front and rear frame portions in a joined relationship when they are pressed together in superimposed alignment;

means on said front and rear frame portions for forming a groove between said portions in the periphery of said frame when said portions are joined together to form said frame;

plate means dimensioned to be received within said groove and being constructed for use in prying apart said front and rear portions by being twisted within said groove, and means on independent bath said front and rear frame portions for receiving and retaining said plate in a position in which said plate forms a supporting leg for said frame.

2. A table-top frame in accordance to with claim 1 wherein said complementary means comprise protrusions on one of said front and rear frame portions and correspondingly positioned receiving cavities on the other of said front and rear frame portions, said protrusions and cavities being disposed on inner surfaces of said front and rear frame portions.

3. A table-top frame in accordance with claim 1 wherein said groove extends around the entire periphery of said frame in the vicinity of the juncture of said front and rear frame portions.

4. A table-top frame in accordance with claim 1 wherein said groove comprises walls which diverge from each other as they extend toward the periphery of said frame.

* * * * *